US009990868B1

(12) United States Patent
Katz et al.

(10) Patent No.: US 9,990,868 B1
(45) Date of Patent: Jun. 5, 2018

(54) COMPACT, CONVERTIBLE EXIT SIGN

(71) Applicant: Best Lighting Products, Inc., Pataskala, OH (US)

(72) Inventors: Jeffrey Katz, Pickerington, OH (US); Qiu Yuan Yuan, Chang Ping (CN); Wang Zhi Wu, Chang Ping (CN)

(73) Assignee: Best Lighting Products, Inc., Pataskala, OH (US)

( * ) Notice: Subject to any disclaimer, the term of this patent is extended or adjusted under 35 U.S.C. 154(b) by 0 days. days.

(21) Appl. No.: 15/420,713

(22) Filed: Jan. 31, 2017

(51) Int. Cl.
*G09F 13/04* (2006.01)

(52) U.S. Cl.
CPC ..... *G09F 13/04* (2013.01); *G09F 2013/0459* (2013.01)

(58) Field of Classification Search
USPC ..... 40/570, 572, 611.08
See application file for complete search history.

(56) References Cited

U.S. PATENT DOCUMENTS 3,402,494 A 9/1968 Gray
5,615,502 A 4/1997 Gabrius
5,685,098 A 11/1997 Wegrzyn
5,768,814 A 6/1998 Kozek et al.
5,797,673 A 8/1998 Logan et al.
5,954,423 A 9/1999 Logan et al.
5,964,051 A * 10/1999 Loeber ..... G09F 13/04 362/249.03
5,966,069 A 10/1999 Zmurk et al.
5,988,825 A * 11/1999 Masters ..... G08B 7/062 362/20
6,152,581 A 11/2000 Masters et al.
6,167,648 B1 1/2001 Dimmick
6,240,665 B1 * 6/2001 Brown ..... G09F 13/04 40/570
6,741,324 B1 5/2004 Kim
6,824,295 B1 11/2004 Grondal
6,848,798 B1 2/2005 Logan et al.
7,350,327 B1 * 4/2008 Logan ..... G09F 7/18 40/570
7,520,072 B2 4/2009 Yu
7,827,714 B2 * 11/2010 Howard ..... F21V 21/116 174/493
7,845,103 B2 12/2010 Logan et al.
8,443,535 B2 5/2013 Liu et al.
8,721,112 B2 5/2014 Hetrick et al.
2011/0134624 A1 * 6/2011 Hetrick ..... F21S 9/022 362/20

* cited by examiner

*Primary Examiner* — Joanne Silbermann
(74) *Attorney, Agent, or Firm* — Diederiks & Whitelaw, PLC

(57) ABSTRACT

A compact exit sign includes a main body having an open frontal portion, an annular side wall portion and a rear panel portion including a central opening extending across greater than half of the rear panel, and a front plate including a face portion provided with exit indicia. The exit sign can be selectively converted between single and double face exit signs by snap-connecting a first, solid and non-transparent insert to the main body across the central opening of the rear panel to establish a single face exit sign and snap-connecting a second, exit indicia containing insert to the main body across the central opening of the rear panel to establish a double face exit sign. A lighting system is housed within the main body for illuminating the exit indicia for either of the single or double face configurations.

20 Claims, 6 Drawing Sheets

COMPACT, CONVERTIBLE EXIT SIGN

BACKGROUND OF THE INVENTION

Field of the Invention

The present invention pertains to the art of exit signs and, more particularly, to a compact exit sign which can be readily converted between single sided and double sided exit signs.

Discussion of the Prior Art

Exit signs are commonly found in essentially all commercial buildings. In general, the purpose of an exit sign is to direct a person's attention to the location of a suitable building exit. To achieve this function, it is known to provide exit signs along corridors in order to lead one to an exit, as well as directly adjacent the exit itself. Typically, such exit signs are mounted on surrounding walls or suspended from a ceiling. In any case, exit signs mark the way for people leaving a building.

In the event of an emergency, such as a building fire, exit signs can play a crucial role in enabling people to safely leave the building in a timely manner. Typically, an audible fire alarm is sounded as an initial indicator of the presence for possibility of a fire. In addition, strobe lights are also often used as visual indicators in such emergency situations, especially in large scale commercial buildings such as hotels, hospitals, convention centers, large office buildings and the like. Furthermore, it is known in the art to provide auxiliary lighting on the housing of an exit sign in order to illuminate the area leading to and around the exit.

In accordance with the prior art, an exist sign can either be one-sided or single faced so as to provide an illuminated "EXIT" on one major face while an opposing face is constituted by a smooth, solid wall or two-sided or double faced wherein each of the opposing faces provides an illuminated "EXIT" indication. Such exit signs can be mounted in a number of ways, mainly: flat against a wall in the case of a one-sided exit sign; mounted perpendicular to a vertical building wall from a side of the sign, which mounting can be employed for either one or two-sided signs; or hanging from a ceiling with either one or two sides presenting the exit indicia.

Regardless of the specific type of exit sign, the sign will generally have, as represented by the known exit sign 5 configuration shown in FIG. 1, a central body 10 in which is positioned a circuit board and other electronic components (not shown) and to which are attached front 12 and rear plates 14. More specifically, each of the front and rear plates 12 and 14 includes a face portion, such as face portion 18 for front plate 12, which can either include "EXIT" indicia 20 or be solid in establishing the one or two-sided signs. In addition, each front and rear plate 12, 14 includes a respective peripheral side wall portion 22, 24 which actually attaches to central body 10 and adds to the overall thickness of exit sign 5. The perceived problem with these types of signs is that they tend to be quite bulky, particularly due to the inclusion of the peripheral side wall portions 22 and 24, as well as the central mounting of all the electronics. This problem is most evident in connection with exist signs which mount flat against a wall as the sign tends to project from the wall for a significant distance, such as in the order of three (3) or more inches. When mounted in a narrow hallway, such a sign is quite prevalent. In addition, with the illumination source(s) for the sign being internally mounted and the electronics generally centrally located, it is not uncommon for the illuminated "EXIT" insignia 20 to include shadows or simply variations in color for the typically green or red illuminated areas. With all this in mind, it would be beneficial to provide a more aesthetically pleasing, compact exit sign which can be uniformly illuminated and readily converted between single and double face exit sign styles.

SUMMARY OF THE INVENTION

In accordance with the present invention, an exit sign includes a main body having an open frontal portion, an annular side wall portion and a rear panel portion, with the rear panel portion including a central opening extending across greater than half of the rear panel. The exit sign also includes a front plate having a face portion, provided with exit indicia, and a peripheral side wall portion mating with the annular side wall portion of the main body in interconnecting the front plate to the main body.

The exit sign can be utilized with either a first, solid and non-transparent insert secured to the main body across the central opening of the rear panel or a second, exit indicia containing insert secured to the main body across the central opening of the rear panel. A lighting system is housed within the main body for illuminating the exit indicia in the insert and/or the front plate.

With this construction, the exit sign only employs two components which add to the overall thickness of the unit. Therefore, the exit sign is quite compact, having a maximum thickness of no greater than one (1) inch, preferably about ¾ inches, thereby enabling the exit sign to be advantageously mounted extremely flat to a wall. In addition, depending upon the insert selected for use, the exit sign can be easily converted between single and double face exit signs.

Additional objects, features and advantages of the present invention will become more readily apparent to one of ordinary skill in the art from the following description of a preferred embodiment, particularly when taken in conjunction with the drawings wherein like reference numerals reference corresponding structure in the several views.

DETAILED DESCRIPTION OF THE INVENTION

Figure 1:
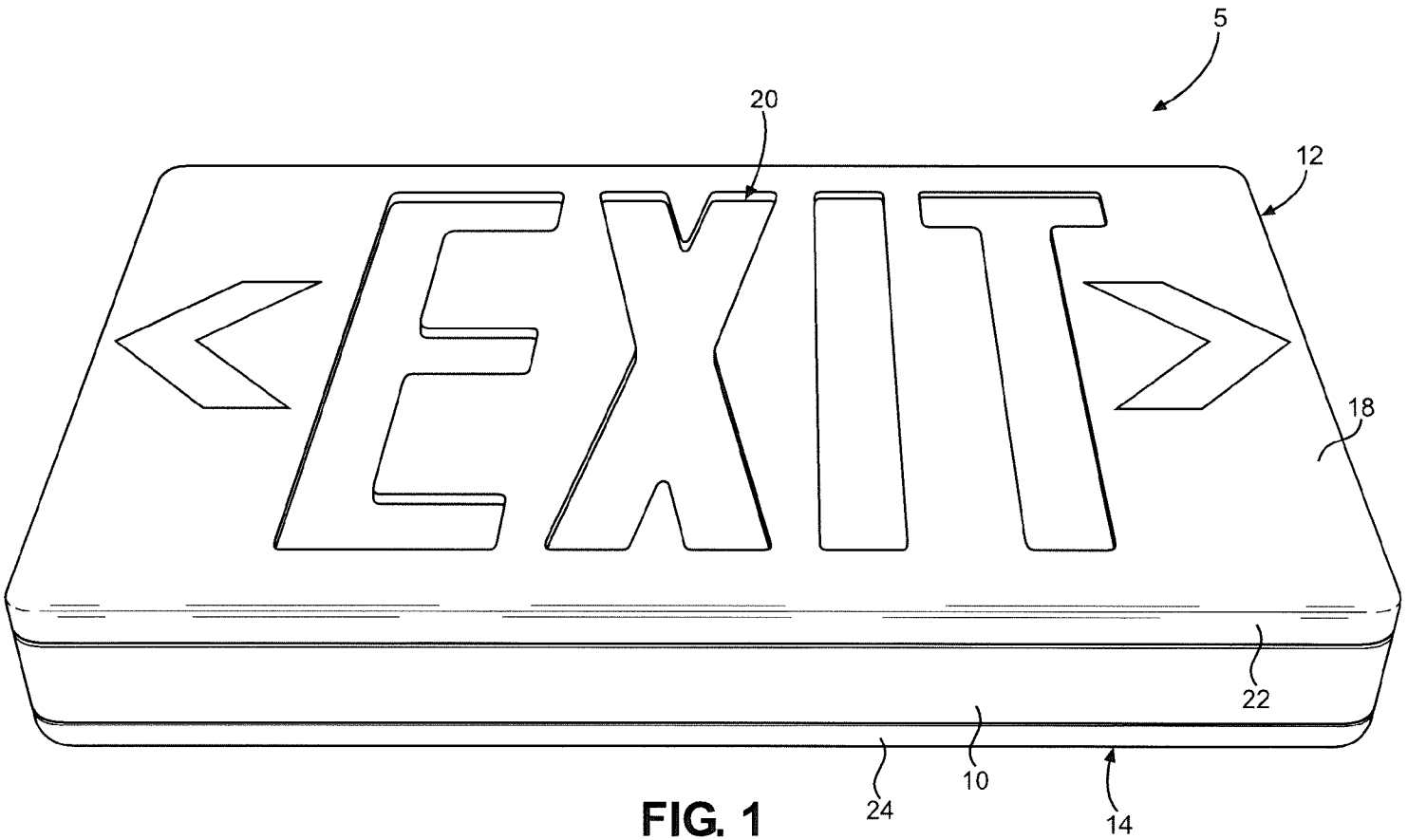
FIG. 1 PRIOR ART
FIG. 1 is a perspective view of an exit sign constructed in accordance with the prior art.
Figure 2:
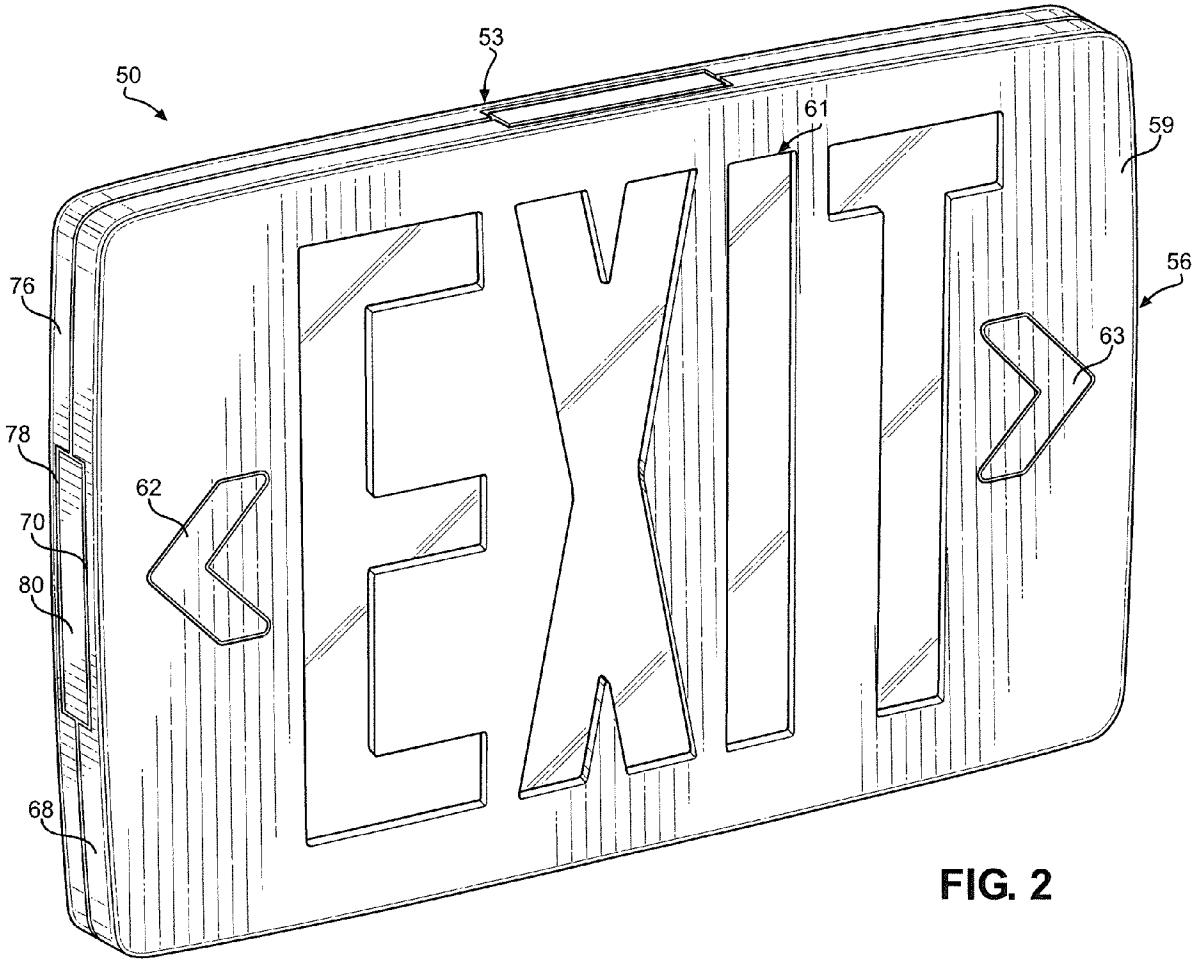
FIG. 2 is a front perspective view of a compact exit sign constructed in accordance with the present invention.

With initial reference to FIG. 2, an exit sign constructed in accordance with the invention is generally indicated at 50. Exit sign 50 includes a main body 53 and a front plate 56 having a face portion 59 including cut-out "EXIT" indicia 61, as well as side arrow symbols 62 and 63. Front plate 56 also includes a peripheral side wall portion 68 extending from face portion 59. As shown in this figure, peripheral side wall portion 68 is formed with a cut-out section 70 on one side thereof. Actually, as will become more fully evident below, various cut-out sections can be provided about the periphery of front plate 56 for use in connection with mounting exit sign 50 in one of various, selectively different configurations. As shown, main body 53 includes an annular side wall portion 76 which mates with peripheral side wall portion 68 upon assembling exit sign 50. Annular side wall portion 76 is depicted as including a cut-out section 78 corresponding to cut-out section 70. A cover piece 80 is mounted at cut-out sections 70 and 78, with cover piece 80 being readily removable to accommodate mounting hardware if it is desired for exit sign 50 to be side mounted to a wall or the like in a manner known in the art.

Figure 3:
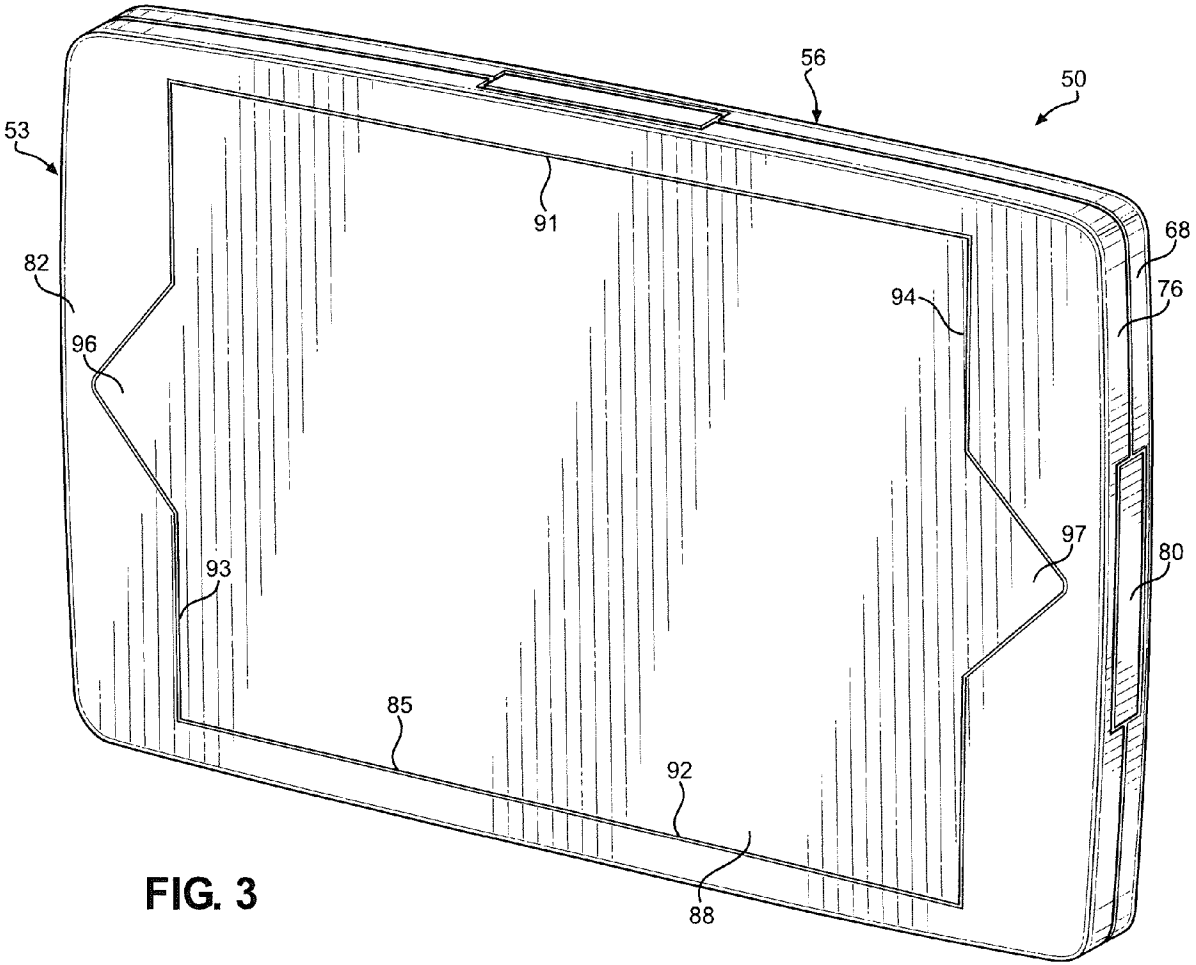
FIG. 3 is a rear perspective view of the exit sign of the invention with a rear panel of the exit sign having mounted thereto a first insert.

FIG. 3 presents a rear perspective view of exit sign 50. In particular, main body 53 includes a rear panel portion 82 which is integrally formed with annular side wall portion 76. Rear panel portion 82 is formed with a central opening 85 which extends across greater than half of the rear panel portion 82, preferably greater than ¾ of rear panel portion 82. Mounted within central opening 85 is an insert 88. As shown, insert 88 is polygon in shape, including upper, lower and side edges 91-94. Side edges 93 and 94 are preferably mirror images of one another, while defining generally triangular-shaped apex portions 96 and 97 respectively. Main body 63, front plate 56 and insert 88 are made of a non-transparent material, such as plastic. Insert 88 is designed to be flush with rear panel portion 82 such that the overall thickness of exit sign 50 is established by only the combined dimensions of main body 53 and front plate 56 and, more specifically, the combined thicknesses of peripheral side wall portion 68 and annular side wall portion 76. With this construction, exit sign 50 can be quite thin, preferably in the order of ¾ inch, but certainly with a maximum thickness of no greater than 1.0 inch, thereby enabling exit sign 50 to be advantageously mounted extremely flat to a wall if desired.

Figure 4:
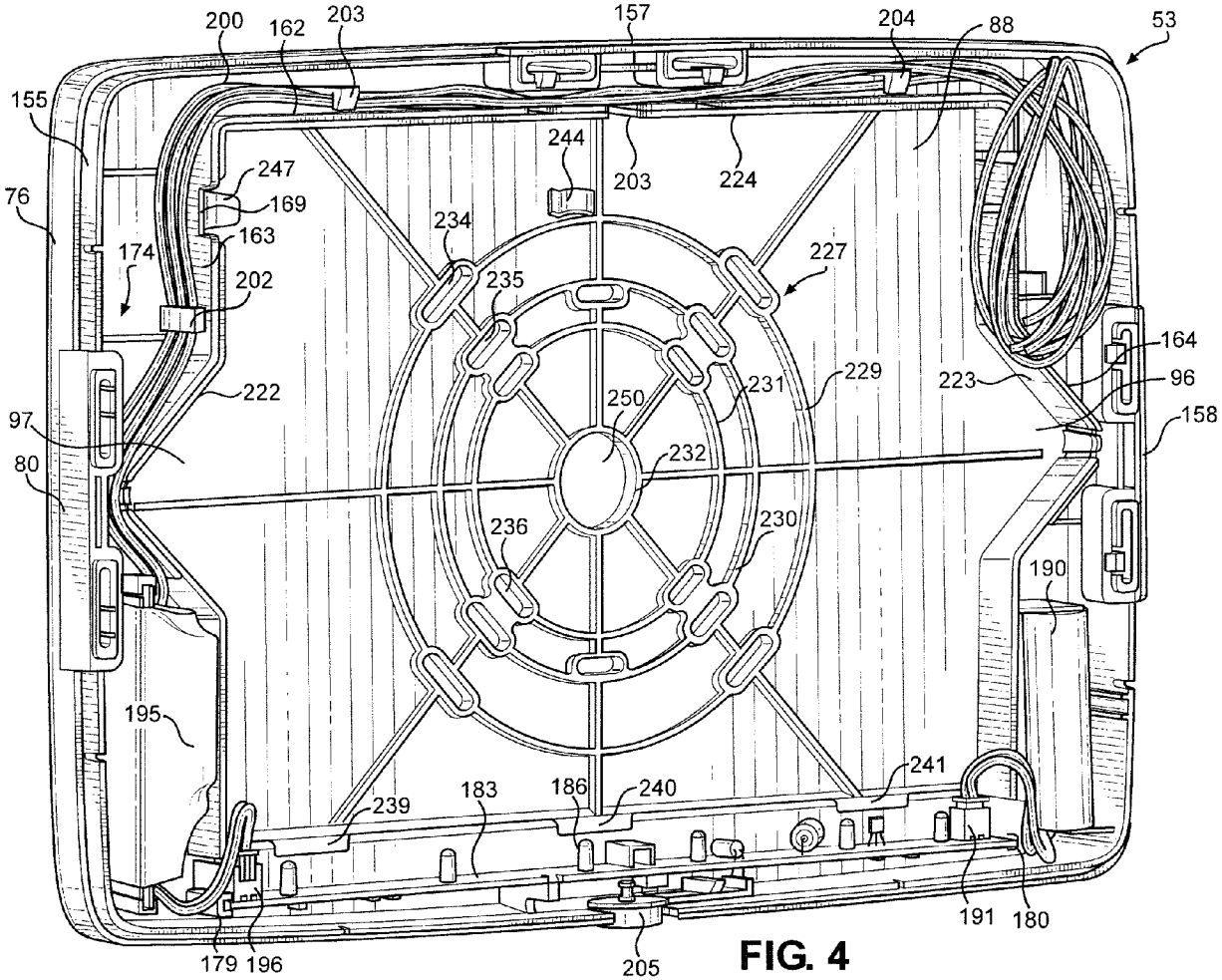
FIG. 4 is a front perspective view of the exit sign with a front panel removed.

FIG. 4 depicts exit sign 50 with front plate 56 removed, thereby showing the interior structure of an open frontal portion of main body 53 and insert 88. Initially, it is pointed out that main body 53 is preferably formed with a recessed annular side wall portion 155 which is integral with annular side wall portion 76 but spaced inward by a distance corresponding to a thickness of peripheral side wall portion 68. As referenced above, cover piece 80 enables exit sign 50 to be mounted from one side. This figure shows additional cover pieces 157 and 158 which enable exit sign 50 to be selectively mounted from above or an opposing side, respectively. Main body 53 is also internally formed with upstanding top and side walls 162-164 which are spaced inward from three corresponding sections of annular side wall portion 76 and define, at least in part, central opening 85 (not separately labeled in FIG. 4). At opposing upper locations, each side wall 163, 164 has a cut-out section, one of which is indicated at 169, the purpose of which will be detailed below.

Between annular side wall portion 76 and upstanding interior walls 162-164 is defined at least one elongated cavity 174. Below upstanding side walls 163 and 164 are arranged channel members 179 and 180 which support a light board or bar 183 including a series of spaced LEDs, one of which is labeled at 186. Preferably, LEDs 186 can be powered by either a battery 190 which is connected to light board 183 through a plug 191 or a control unit 195 connected to light board 183 through a plug 196. Stemming from control unit 195 is also wiring 200 which is routed through elongated cavity 174, preferably with the aid of various wire retainer/routing guides 202-204. As exit sign 50 is not shown to be electrically connected, terminal ends of wiring 200 are shown to be bunched in the upper right corner of elongated cavity 174. Upon making an electrical connection, wiring 200 can be further routed outside of exit sign 50 by removal of one of cover pieces 80, 157 or 158. Alternatively, if exit sign 50 is to be mounted flat against a wall, wires 200 can be further routed through a passage 203 formed in upstanding top wall 162 towards a central region of exit sign 50 as will be discussed further below. A bottom button 205 is provided for testing purposes.

As also shown in this figure, upstanding side walls 163 and 164 establish trough portions (not separately labeled) which match apex portions 96 and 97 in shape. Insert 88 is provided with upstanding outermost side walls 222 and 223, as well as an upstanding outermost top wall 224. Centrally located on insert 88 is mounting plate structure generally indicated at 227, with mounting plate structure 227 being shown as including rib reinforced concentric rings 229-232 having various associated punch-out regions, such as those indicated at 234-236. Along a lower edge (not separately labeled) of insert 88, various spaced tabs 239-241 are provided. In addition, provided substantially along a central vertical axis of insert 88 is a wire clip 244.

With this construction, insert 88 can be selectively snap-connected to main body 53 by initially engaging tabs 239-241 with rear panel portion 82 and then pivoting insert 88 fully into central opening 85, whereupon various clips, such as represented by clip 247, snap into engagement with at least upstanding side walls 163 and 164. At the same time, upstanding outermost side and top walls 222-224 of insert 88 extend generally parallel to and directly juxtapose, so as to tightly conform, to upstanding top and side walls 162-164 of main body 53 to provide significant overall structural integrity through a very secure fit. This is considered to be most important when exit sign 50 is to be mounted flat to a wall having a junction box (not shown) including mounting supports which will align with one or more sets of punch out regions 234-236. In addition, centermost wall section 250 of insert 88 can be punched out, enabling wiring 200 to be readily routed under wire clip 244 and into the junction box for hard wiring exit sign 50. It should be noted that wire clip 244 is strategically located relative to exit indicia 61 such that wires 200 will not be directly behind the letters of exit indicia 61, thereby avoiding the creation of any shadow upon the exit indicia 61 upon illumination of LEDs 186. In other words, with the lighting system being completely located radially outward of the central region of main body 53, this region is substantially void of any components of the lighting system which could potentially cast a shadow on exit indicia 61, thereby assuring a bright and uniform lighting arrangement.

Figure 5:
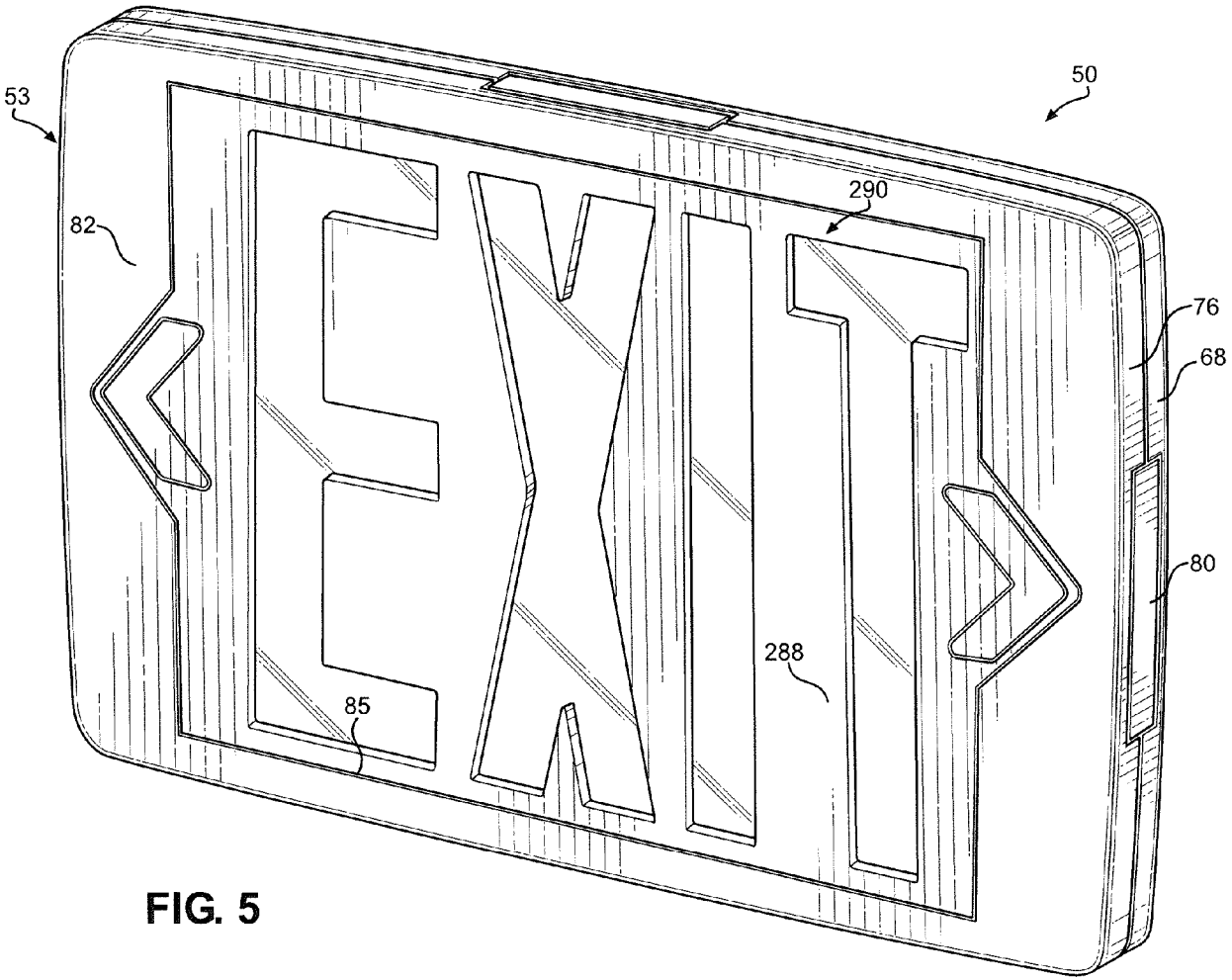
FIG. 5 is a rear perspective view similar to FIG. 3 but showing a second insert mounted to the rear panel of the exit sign.

In addition to providing a compact arrangement, exit sign 50 of the present invention is advantageously configured to be selectively convertible between a single face exit sign employing insert 88 as described above and a double face exit sign employing a second, replacement insert 288 as depicted in FIG. 5. Essentially, inserts 88 and 288 are identically constructed, except insert 288 further includes additional exit indicia 290, just like exit indicia 61 of face portion 59. Obviously, this double face configuration would not be utilized when exit sign 50 is mounted flat against a wall, but can be employed with other mounting configurations, such as side or top mount arrangements, where both of the major faces of exit sign 50 can be viewed. As the central region of main body 53 is void of components of the lighting system, LEDs 186 can be utilized in simultaneously illuminating both exit indicia 61 and 290. As main body 53 includes the trough portions to match apex portions 96 and 97 of insert 88, the directional arrow symbols (not separately labeled) associated with insert 288 are correspondingly accommodated in these general regions. With the same snap-connection arrangement for both insert 88 and insert 288, exit sign 50 can easily be converted between single and double face exit signs, while still maintaining the same overall compact dimensions.

Figure 6:
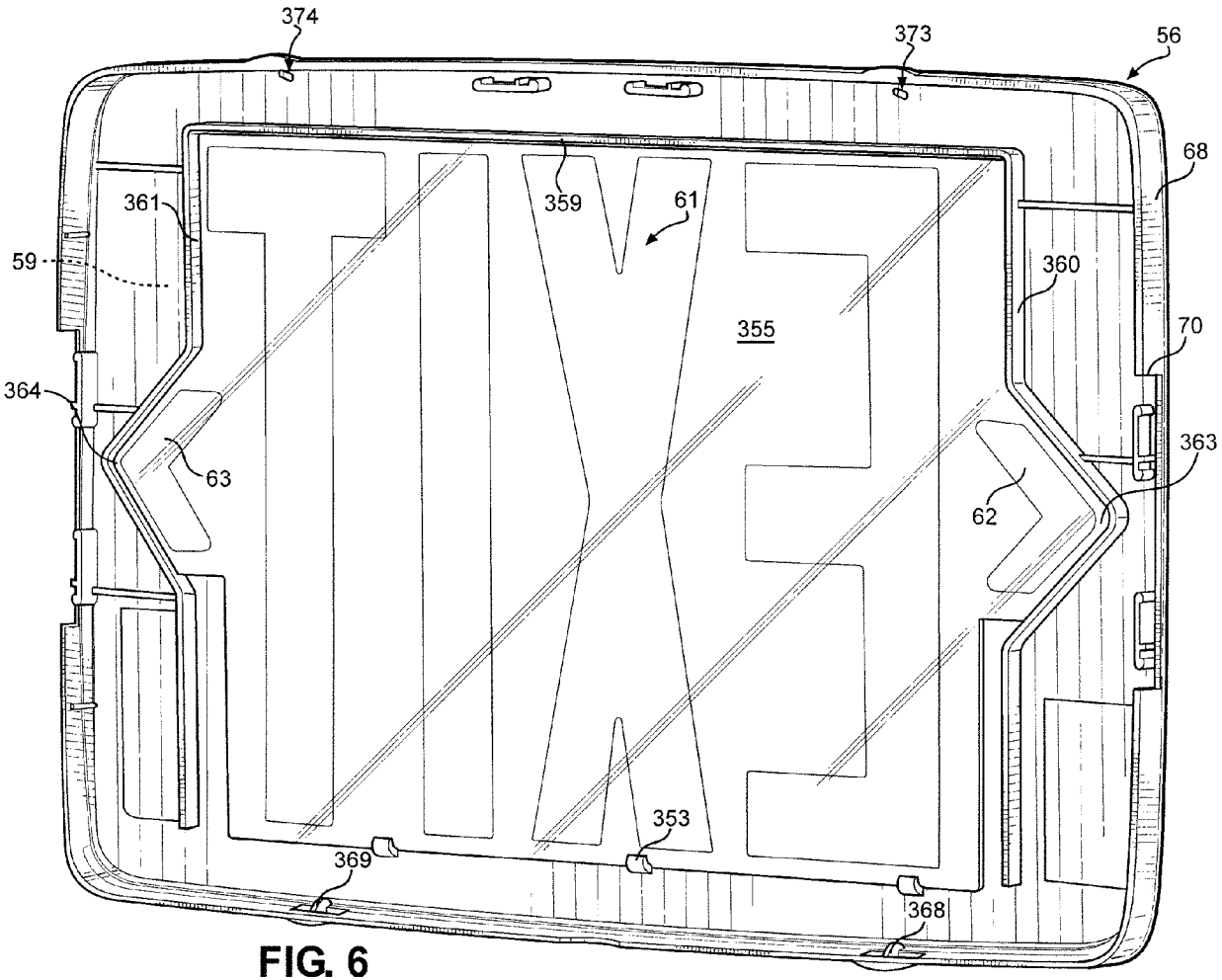
FIG. 6 is a perspective view of an inner side portion of the front panel.

For the sake of completeness, FIG. 6 is provided to illustrate a preferred structural arrangement for establishing exit indicia 61. A lower rear portion of front plate 56 is formed with various spaced catch members, one of which is labeled 353, which support a colored, transparent panel 55. Front plate 56 is also shown to include upstanding inner top and side walls 359-361 which frictionally engage corresponding edge portions of transparent panel 355, which includes apex portions 363 and 364 that extend across symbols 62 and 63. Lower detent members 368 and 369 are employed in combination with upper clip members 373 and 374 in removably fastening front plate 56 to main body 55.

Although described with reference to preferred embodiments, it should be readily understood that various changes and/or modifications could be made to the invention without departing from the spirit thereof. It must also be noted that relative terms such as top, bottom, left and right are included for ease of understanding, and are not to be considered as limiting with regards to the above-described invention.

We claim:

1. An exit sign comprising:

a main body including an open frontal portion, an annular side wall portion and a rear panel portion, said rear panel portion including an outer exposed side having a central opening, with the central opening extending across greater than half of the rear panel portion;

a front plate including a face portion provided with exit indicia, said front plate including a peripheral side wall portion mating with the annular side wall portion of the main body in interconnecting the front plate to the main body;

an insert readily removably secured to the main body across the central opening of the rear panel from the outer exposed side of the rear panel portion toward the face portion, wherein the insert is flush with the rear panel portion such that an overall thickness of the exit sign is established by only combined dimensions of the main body and the front plate; and a lighting system housed within the main body for illuminating the exit indicia.

2. The exit sign according to claim 1, wherein the insert is snap-connected to the main body.

3. The exit sign according to claim 2, wherein the insert includes a plurality of spaced tabs tucked behind the rear panel portion and a plurality of spaced clips for further engaging the rear panel portion.

4. The exit sign according to claim 1, wherein the insert is polygonal in shape.

5. The exit sign according to claim 4, wherein the insert includes upper and lower edges extending generally parallel to upper and lower sections of the annular side wall portion respectively, as well as side edges shaped as mirror images of each other.

6. The exit sign according to claim 5, wherein each of the side edges includes an apex portion projecting to a respective side section of the annular side wall portion.

7. The exit sign according to claim 1, wherein the main body includes upstanding interior walls spaced from and extending along at least two sides of the annular side wall portion so as to establish both the central opening and at least one elongated cavity between the upstanding interior walls and the at least two sides of the annular side wall portion.

8. The exit sign according to claim 7, wherein the insert includes upstanding peripheral side portions which extend directly juxtapose the upstanding interior walls.

9. The exit sign according to claim 7, wherein the lighting system includes a light bar mounted within the main body directly along another side of the annular side wall, wiring routed within the at least one elongated cavity and a battery located within the elongated cavity, and wherein a region within the main body directly exposed to the central opening is substantially void of the wiring or other components of the lighting system which could, upon activation of the lighting system, create a shadow upon the exit indicia.

10. The exit sign according to claim 1, further comprising: a replacement insert configured to be mounted in the central opening when the insert is removed, said replacement insert including additional exit indicia which can be illuminated by the lighting system, thereby converting the exit sign to a double face exit sign.

11. The exit sign according to claim 1, wherein the combined dimensions are no greater than 1 inch.

12. A convertible single-to-double face exit sign assembly comprising:

a main body including an open frontal portion, an annular side wall portion and a rear panel portion, said rear panel portion including an outer exposed side having a central opening, with the central opening extending across greater than half of the rear panel;

a front plate including a face portion provided with exit indicia, said front plate including a peripheral side wall portion mating with the annular side wall portion of the main body in interconnecting the front plate to the main body;

a first insert readily removably secured to the main body across the central opening of the rear panel, with the first insert defining a solid, non-transparent member wherein, when the first insert is positioned across the central opening, the first insert is flush with the rear panel portion and the convertible exit sign defines a single face exit sign;

a second insert removably secured to the main body across the central opening of the rear panel from the outer exposed side of the rear panel portion, with the second insert moving from a rear of the exit sign toward the front plate in securing the second insert to the main body and moving away from the front plate toward the rear of the exit sign in removing the second insert from attachment to the main body, and with the second insert including additional exit indicia wherein, when the second insert is positioned across the central opening, the second insert is flush with the rear panel portion and the convertible exit sign defines a double face exit sign; and a lighting system housed within the main body for illuminating the exit indicia and, when the second insert is positioned across the central opening, the additional exit indicia.

13. The convertible exit sign according to claim 12, wherein each of the first and second inserts is configured to be snap-connected to the main body.

14. The exit sign according to claim 13, wherein the insert includes a plurality of spaced tabs tucked behind the rear panel portion and a plurality of spaced clips for further engaging the rear panel portion.

15. The exit sign according to claim 12, wherein the insert is polygonal in shape.

16. The exit sign according to claim 15, wherein the insert includes upper and lower edges extending generally parallel to upper and lower sections of the annular side wall portion respectively, as well as side edges shaped as mirror images of each other.

17. The exit sign according to claim 16, wherein each of the side edges includes an apex portion projecting to a respective side section of the annular side wall portion.

18. A method of converting an exit sign, including a main body having an open frontal portion, an annular side wall portion and a rear panel portion including an outer exposed side having a central opening extending across greater than half of the rear panel portion, and a front plate including a face portion provided with exit indicia, between single face and double face exit signs comprising:

when establishing a single face exit sign, connecting a first insert to the main body across the central opening of the rear panel portion, with the first insert being flush with the rear panel portion and defining a solid, non-transparent member; and when establishing a double face exit sign, connecting a second insert to the main body across the central opening and flush with the rear panel portion from the outer exposed side of the rear panel portion, with the second insert moving from a rear of the exit sign toward the front plate in securing the second insert to the main body and moving away from the front plate toward the rear of the exit sign in removing the second insert from attachment to the main body, and with the second insert including additional exit indicia.

19. The method of claim 18, wherein each of the first and second inserts is snap-connected to the main body.

20. The method of claim 19, wherein each of the first and second inserts includes a plurality of spaced tabs which are tucked behind the rear panel portion and a plurality of spaced clips for snap-connecting a respective one of the first and second inserts to the rear panel portion.

* * * * *